United States Patent [19]

Michalopoulos et al.

[11] Patent Number: 4,847,772

[45] Date of Patent: Jul. 11, 1989

[54] VEHICLE DETECTION THROUGH IMAGE PROCESSING FOR TRAFFIC SURVEILLANCE AND CONTROL

[75] Inventors: Panos G. Michalopoulos; Richard A. Fundakowski, both of St. Paul; Meletios Geokezas, White Bear Lake; Robert C. Fitch, Roseville, all of Minn.

[73] Assignee: Regents of the University of Minnesota, Minneapolis, Minn.

[21] Appl. No.: 15,104

[22] Filed: Feb. 17, 1987

[51] Int. Cl.[4] ..... G08G 1/01

[52] U.S. Cl. ..... 364/436; 340/937; 382/10

[58] Field of Search ..... 364/436, 521, 515, 518; 358/105; 340/937, 910, 917, 934, 935; 382/10, 16, 18, 39

[56] References Cited

U.S. PATENT DOCUMENTS

| | | | |
|---|---|---|---|
| 3,663,937 | 5/1972 | Bolner | 340/937 |
| 3,930,735 | 1/1976 | Kerr | 340/937 |
| 4,214,265 | 7/1980 | Olesen | 340/937 |
| 4,433,325 | 2/1984 | Tanaka et al. | 340/937 |
| 4,490,851 | 12/1984 | Gerhart et al. | 382/43 |
| 4,709,264 | 11/1987 | Tamura et al. | 358/93 |

*Primary Examiner*—Parshotam S. Lall
*Assistant Examiner*—Thomas G. Black
*Attorney, Agent, or Firm*—Kinney & Lange

[57] ABSTRACT

A vehicle detection system for providing data characteristic of traffic conditions includes a camera overlooking a roadway section for providing video signals representative of the field (traffic scene), and a digitizer for digitizing these signals and providing successive arrays of pixels (picture elements) characteristic of the field at successive points in space and time. A video monitor coupled to the camera provides a visual image of the field of view. Through use of a terminal and in conjunction with the monitor, an operator controls a formatter so as to select a subarray of pixels corresponding to specific sections in the field of view. A microprocessor then processes the intensity values representative of the selected portion of the field of view in accordance with spatial and/or temporal processing methods to generate data characteristic of the presence and passage of vehicles. This data can be utilized for real-time traffic surveillance and control, or stored in memory for subsequent processing and evaluation of traffic flow conditions.

33 Claims, 5 Drawing Sheets

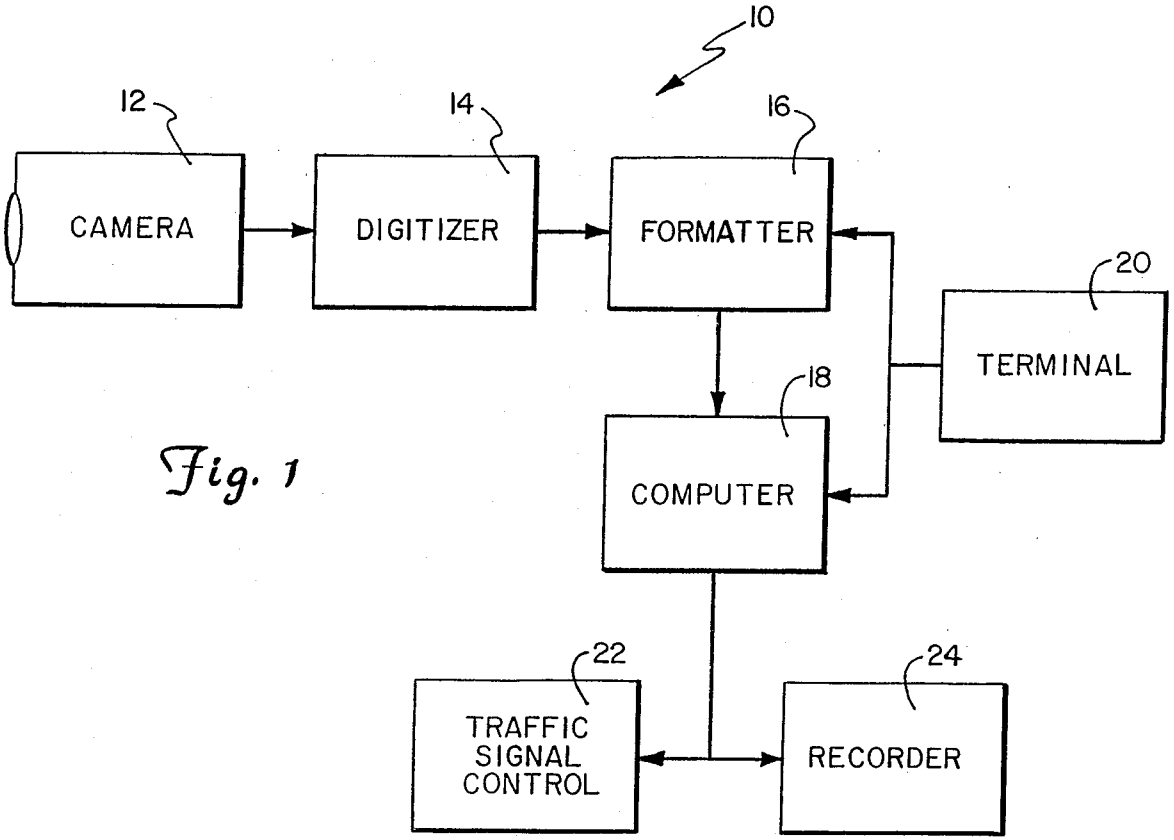
Fig. 1
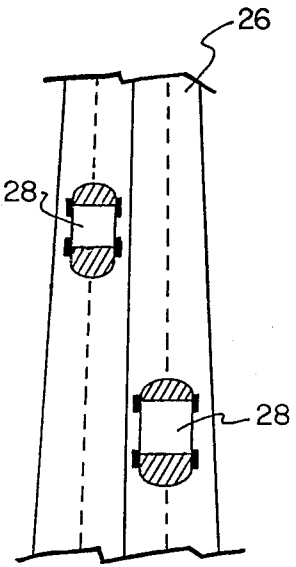

Fig. 11

$$\hat{I}_{ij}^{n} = \hat{I}_{ij}^{(n-1)} + \frac{1}{N}\left(I_{ij}^{n} - I_{ij}^{n-N}\right) \text{ for } ij \text{ of the selected window} \qquad \text{Eq. 1.}$$

where:

$$I_{ij}^{n-N} \text{ is } I_{ij} \text{ of the previous } N\text{th frame} \qquad \text{Eq. 2.}$$

and:

$$\hat{I}_{ij}^{(n-1)} = \frac{1}{N}\sum_{\ell=1}^{N} I_{ij}^{n-(\ell+1)} \qquad \text{Eq. 3.}$$

$$\bar{I}_{ij}^{n} = I_{ij}^{n} - \hat{I}_{ij}^{n} \text{ for } ij \text{ of the selected window} \qquad \text{Eq. 4}$$

$$A_{ij}^{n} = \frac{1}{L}\sum_{\ell=1}^{L} \bar{I}_{i(j-\ell)}^{n} \qquad \text{Eq. 5}$$

$$A_{ij}^{n} = \frac{1}{M}\sum_{m=1}^{M} \bar{I}_{(i-m)j}^{n} \qquad \text{Eq. 6}$$

$$A_{ij}^{n} = \frac{1}{ML}\sum_{m=1}^{M}\sum_{\ell=1}^{L} \bar{I}_{(i-m)(j-\ell)}^{n} \qquad \text{Eq. 7}$$

$$A_{ij}^{n} = \frac{1}{6}\sum_{\ell=1}^{6} \bar{I}_{i(j-\ell)}^{n} \qquad \text{Eq. 8}$$

$$V_{ij}^{n} = \frac{1}{L}\sum_{\ell=1}^{L}\left(\bar{I}_{i(j-\ell)}^{n} - A_{i(j-\ell)}^{n}\right)^2 \qquad \text{Eq. 9}$$

$$\text{If } V_{ij}^{n} > k_A V_{ij}^{n} \text{ for } 1 < k < d,\ P_{ij}^{n} = 1, \text{ otherwise } P_{ij}^{n} = 0 \text{ or } \bar{I}_{ij}^{n} > kf\left({}_A V_{ij}^{n}\right) \qquad \text{Eq. 10}$$

$$\text{If } \sum_{j=1}^{6} P_{ij} \geq 4, \text{ then vehicle present} \qquad \text{Eq. 11}$$

$$Q_{ij}^{n} = \frac{1}{R}\sum_{r=1}^{R}\left(\bar{I}_{ij}^{n-(r-1)} - M_{ij}\right)^2 \qquad \text{Eq. 12}$$

$$M_{ij} = \frac{1}{N}\sum_{\ell=1}^{N} \bar{I}_{ij}^{n-(\ell-1)} \qquad \text{Eq. 13}$$

$$\text{If } \bar{I}_{ij}^{n} > kf\left({}_A Q_{ij}^{n}\right) \text{ for } 1 < k < 4,\ P_{ij}^{n} = 1, \text{ otherwise } P_{ij}^{n} = 0 \qquad \text{Eq. 14}$$

$$V = D/\Delta T \qquad \text{Eq. 15}$$

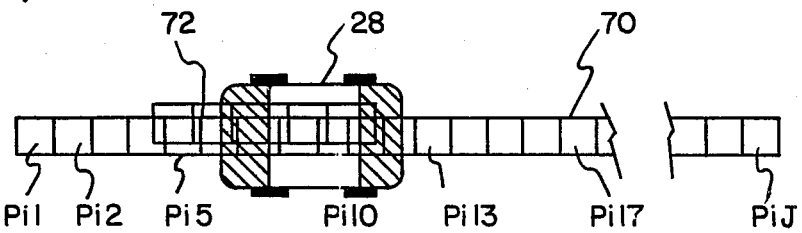

Fig. 8

VEHICLE DETECTION THROUGH IMAGE PROCESSING FOR TRAFFIC SURVEILLANCE AND CONTROL

BACKGROUND OF THE INVENTION

1. Field of the Invention

The present invention relates generally to traffic detection and monitoring equipment. In particular, the present invention is a vehicle detection system in which infrared or visible images of highway/street scenes are processed by digital computing means to determine vehicle presence, passage, measure various traffic parameters and facilitate traffic surveillance and control. The system also can be used as a vehicle counter/classifier, and other traffic engineering applications such as incident detection, safety analysis, measurement of traffic parameters, etc.

2. Description of the Prior Art

Traffic signals are extensively used to regulate the flow of traffic at both high volume urban intersections, and rural or suburban low volume intersections where safety rather than capacity and efficiency is the major concern. The timing of traffic control signals (i.e., the cycle time and amount of green provided to each movement) is either fixed through the use of historical data, or variable and based upon real-time sensed data. Timing sequences of pretimed traffic control signals are derived from historical information concerning the demand patterns, while real-time traffic control decisions are derived from actual traffic flow information. This information can be processed locally, or remotely-transmitted to a central computer where decisions about signal settings are made. Real-time traffic control signals have the ability to respond to rapid demand fluctuations and are in principle more desirable and efficient than pretimed signals.

Currently used equipment for real-time control of traffic signals is expensive and often inaccurate. Effective traffic sensing for surveillance and control of freeways and arterial streets requires vehicle detection, counting, classifying and other traffic parameter measurements. The overwhelming majority of such detectors are of the inductive loop type, which consist of wire loops placed in the pavement to sense the presence of vehicles through magnetic induction. Since the information extracted from such detectors is very limited, installation of a number of such detectors is often required to obtain requisite data for sophisticated traffic control and surveillance systems. For example, measurements of traffic volume by lane require at least one detector per lane, while measurement of speed requires at least two detectors. A problem with existing systems is reliability and maintenance. In major cities 25%–30% of inductive loops are not operational. In addition, inductive loops are expensive to install.

Electro-optical vehicle detection systems which utilize visible or infrared sensors have been suggested as a replacement for wire loop detectors. The sensor of such systems, such as an electronic camera, is focused upon a field of traffic and generates images at predetermined frame rates (such as standard television). Under computer control, frame data with traffic images is captured, digitized, and stored in computer memory. The computer then processes the stored data. Vehicle detection can be accomplished by comparing the image of each selected window with a background image of the window in the absence of vehicles. If the intensity of the instantaneous image is greater than that of the background, vehicle detection is made. After detection, the vehicle's velocity and signature can be extracted. From this, traffic data can be extracted and used for traffic control and surveillance.

In order for electro-optical vehicle detection systems of this type to be cost effective, a single camera must be positioned in such a manner that it covers a large field of traffic so that all necessary information can be derived from the captured image. In other words, one camera must be capable of providing images of all strategic points of an intersection approach or of a roadway section from which it is desired to extract information. The time required by the computer to process frames of these images is very critical to real-time applications. Furthermore, currently used methods for processing the data representative of the images are not very effective.

It is evident that there is a continuing need for improved traffic control and surveillance systems. To be commercially viable, the system must be reliable, cost-effective, accurate and perform multiple functions. There is a growing need for controlling traffic at congested street networks and freeways. This can only be accomplished through real time detection and surveillance devices. Such a machine-vision device is proposed here. The ultimate objective is to replace human observers with machine-only vision for traffic surveillance and control. Finally, the proposed device increases reliability and reduces maintenance since it does not require placement of wires to the pavement.

SUMMARY OF THE INVENTION

A vehicle detection system in accordance with one embodiment of the present invention includes sensor means for sensing the field of traffic and for providing successive arrays of pixels characteristic of the field. Formatter means coupled to the sensor means select a subarray of pixels characteristic of a portion of the field of traffic. Processor means process the selected subarray of pixels and provide data representative of vehicle presence and/or passage within the portion of the field represented by the subarray.

In one embodiment, the processor means spatially processes the pixel arrays to generate data characteristic of vehicle presence and/or passage. In another embodiment, the processor means temporally processes the pixel arrays to generate data characteristic of the vehicle presence and/or passage within the field. In still another embodiment, the processor means logically combines the spatially processed data and temporally processed data to generate data characteristic of vehicle presence and/or passage within the field.

The vehicle detection system of the present invention is both effective and cost efficient. Use of the formatter permits specific sections or portions of images produced by the camera to be selected and processed. A single camera can therefore be effectively used for multiple detection, i.e. detection of many points along the roadway. Portions of the image which are not required to be processed are not used, thereby saving computer time. Furthermore, the temporal and spatial data processing methods can quickly process data and produce accurate results. Accurate real-time traffic control can thereby be implemented.

BRIEF DESCRIPTION OF THE DRAWINGS

FIG. 1 is a block diagram representation of a vehicle detection and traffic control system in accordance with the present invention.

FIG. 8 is a graphic representation of the logic processing step illustrated in FIG. 8.

FIG. 11 describes equations 1–15 which are implemented by the system shown in FIG. 1.

DETAILED DESCRIPTION OF THE PREFERRED EMBODIMENTS

Figure 2:
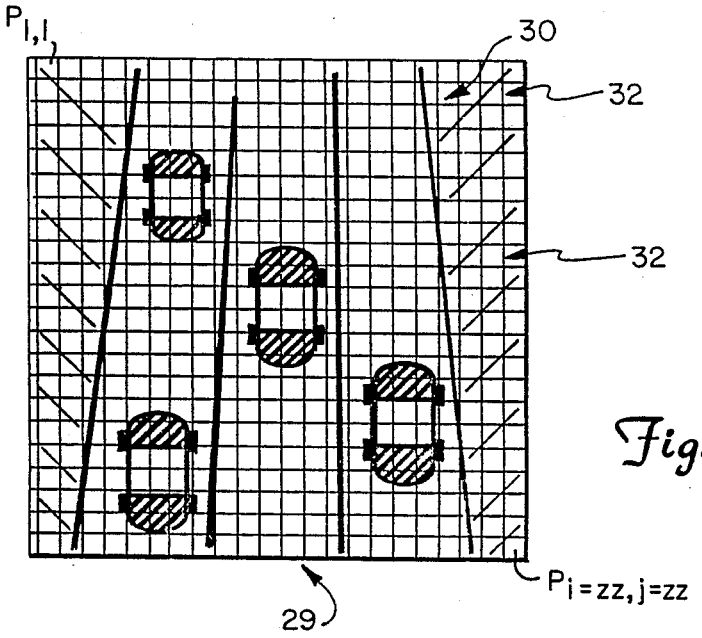
FIG. 2 is a graphic representation of a digitized frame of an image captured by the camera shown in FIG. 1.

A vehicle detection and traffic control system 10 in accordance with the present invention is illustrated generally in FIG. 1. As shown, vehicle detection system 10 includes a sensor such as camera 12, monitor 13, digitizer 14, formatter 16, computer means such as microprocessor 18, associated random access memory or RAM 17 and read only memory or ROM 19, terminal 20, traffic signal control 22, and recorder 24. Camera 12 can be positioned at a height of twenty-five to forty feet on a streetlight pole, stoplight pole, building or other support structure (not shown) and is focused upon a desired field of traffic on a roadway 26 such as that shown in FIG. 1. Camera 12 can be any of a wide variety of commercially available devices which sense visible energy reflected by vehicles 28 traveling along roadway 26 within the camera's field of view. Camera 12 can operate in a conventional manner using standard television frame rates.

As illustrated in FIG. 2, each successive frame 29 (only one is shown) captures an image 30 of the field of traffic at an instant in time. Camera 12 provides analog video signals characterizing image 30 as a sequence of scan lines 32. Each scan line lasts for approximately 65 microseconds for a frame comprised of 484 scan lines and represents the intensity of energy reflected from a zone of the scene covered by the field of view of the camera. Although camera 12 has been described as one operating in the visible portion of the spectrum, other types of sensors including infrared (IR) sensors which sense infrared energy radiated from a scene can be used as well.

Analog video signals produced by camera 12 are digitized by digitizer 14. Digitizer 14 includes a digital-to-analog converter which converts the analog signals of the scan lines into pixels $I_{ij}^n$ representative of the intensity, I, of image 30 at discrete locations in the ith row jth column of the nth frame as illustrated in FIG. 2. As shown, digitizer 14 breaks image 30 into an i by j frame or array of pixels. Although I=J=twenty-two in the example illustrated in FIG. 2, larger arrays will typically be used.

Depending upon the position and orientation of camera 12 with respect to roadway 26 (FIG. 1), image 30 can be of a rather large field of traffic. However, to extract various types of information from image 30, (e.g., queue length in the leftmost lane, presence of vehicles in an intersection, or velocity of vehicles in the right lane), it is typically necessary to process only certain portions of image 30.

Figure 7:
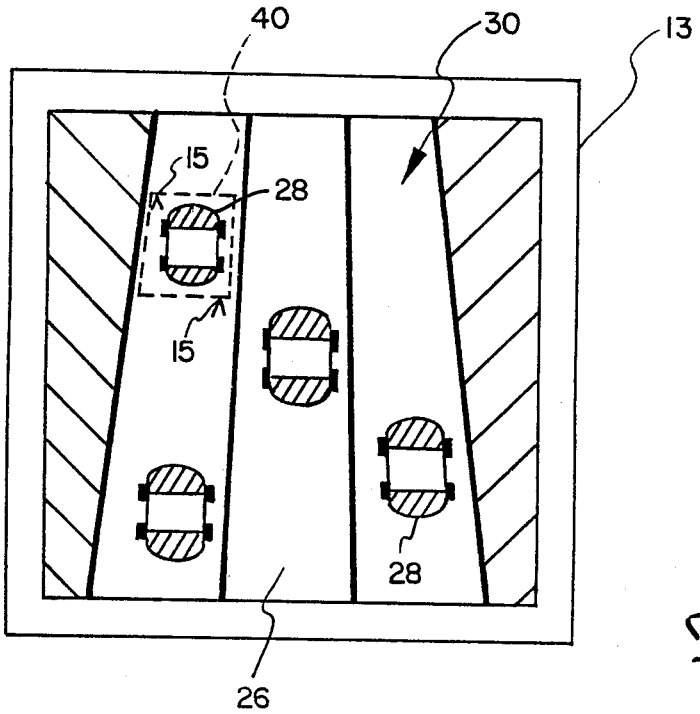
FIG. 7 is a graphic representation of an image displayed by the monitor of FIG. 1 and illustrating the operation of the terminal and formatter.

As illustrated in FIG. 1, monitor 13 is connected to receive the video signals from camera 12, and can thereby provide a real-time display of image 30. FIG. 7 is a graphic representation of an image 30, corresponding to that of FIGS. 2 and 3, being displayed on monitor 13. Using terminal 20, an operator can select a desired portion or window of image 30 for further processing. In one embodiment, the operator uses terminal 20 to position an indicator such as curser 15 (FIG. 7) at locations on monitor 13 which define the desired window. Through terminal 20, the operator can cause formatter 16 to select from digitizer 14 the pixels $I_{ij}^n$ which represent the portion of image 30 within the window. The selected pixels $I_{ij}^n$ are then transferred to microprocessor 18 and stored in RAM 17.

Figure 3:
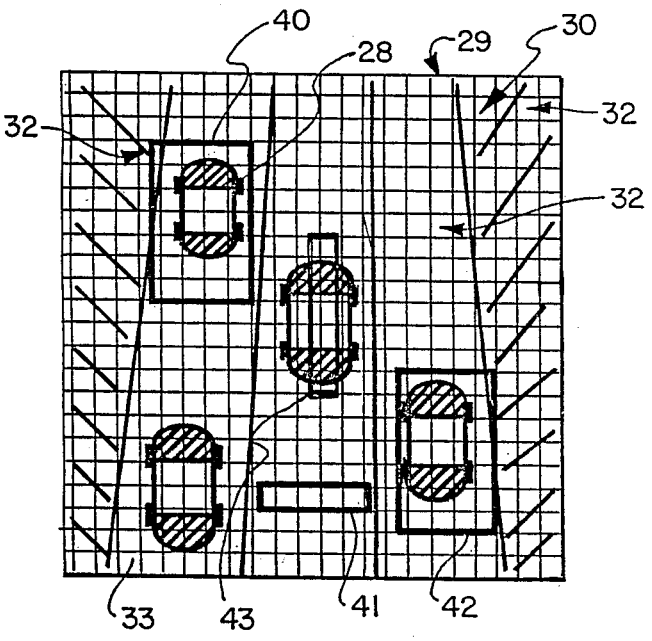
FIG. 3 is a graphic representation illustrating the operation of the formatter shown in FIG. 1.

The above procedure can be described in greater detail with reference to FIGS. 3 and 7. If, for example, it is desired to process data within window 40 in the upper portion of the leftmost lane, the operator can position curser 15 at locations representing the upper left and lower right corners of this window. In response, formatter 16 will select pixels $I_{ij}^n$ for $4 \leqq i \leqq 10$ and $5 \leqq j \leqq 8$ which represent the portion of image 30 within window 40. The pixels will then be transferred through microprocessor 18 to RAM 17. This procedure is repeated for successive frames 29. In a similar manner pixels $I_{ij}^n$ for $i=19$ $9 \leqq j \leqq 13$ representing window 41, or $I_{ij}^n$ for $8 \leqq i \leqq 14$ $j=12$ representing window 43, can be selected.

Once selected and stored, pixels $I_{ij}^n$ representative of successive frames of the windowed portion of image 30 can be processed by microprocessor 18 in accordance with various temporal, spatial and/or other statistical methods to determine the presence, passage, velocity, or other characteristics of the vehicles 28 within the selected window of roadway 26. This data can then be utilized by traffic signal control 22 in known manners to optimize the flow of traffic along roadway 26 in response to currently existing traffic conditions. Alternatively, the data can be recorded by recorder 24 for subsequent processing and/or evaluation.

A spatial data processing method implemented by microprocessor 18 to determine the presence, passage and/or other characteristics of vehicles 28 is described with reference to FIG. 4. The spatial data processing steps illustrated in FIG. 4 enable system 10 to make a determination of the characteristics of vehicles 28 from a single "look" at the field of traffic at one instant of time. This determination is based upon a comparison of measures extracted from an instantaneous image with corresponding measures which are characteristic of background data in the image. The determination of vehicle presence and/or passage is therefore based upon characteristics of an intensity profile of the selected window of image 30 represented by its pixels $I_{ij}^n$. The underlying assumption for the processing approach is that the signature of instantaneous intensity profile of the selected portion of image 30 is significantly altered when a vehicle 28 is present in the field of view.

Pixels $I_{ij}^n$ for the nth frame (latest) of a window such as 43 are first time averaged by microprocessor 18 with corresponding pixels of the previous N frames as indicated at step 50. N is a parameter stored in RAM 17 or ROM 19. In one embodiment, microprocessor 18 processes pixels $I_{ij}^n$ in accordance with the recursive formula defined by equations 1–3 to produce time averaged arrays $\hat{I}_{ij}^n$. Pixels $\hat{I}_{ij}^n$ are representative of the average background intensity of window 43 over the N frames.

Time averaged pixels $\hat{I}_{ij}^n$ are then subtracted from the current array pixels $I_{ij}^n$ as indicated at summation step 52 to generate an array of background adjusted pixels $\bar{I}_{ij}^n$. This operation can be mathematically performed by microprocessor 18 in accordance with equation 4. Utilizing the background adjusted pixels $\bar{I}_{ij}^n$ allows compensation for any natural variations in road surface such as those resulting from transitions between bituminous and concrete, railroad crossings, or markings on road surfaces.

Having computed the background adjusted pixels $\bar{I}_{ij}^n$, microprocessor 18 generates a spatially averaged array $A_{ij}^n$ according to Equations 5 or 6. The size of the averaging window is chosen to be representative of the size of a vehicle 28, and will therefore vary depending upon the position and orientation of camera 12 with respect to roadway 26 (FIG. 1).

Microprocessor 18 can compute spatially averaged pixels $A_{ij}^n$ for a 1 by J horizontal window such as 41 using a 1 by L averaging window in accordance with equation 5. In a similar manner, equation 6 can be used to compute spatially averaged pixels $A_{ij}^n$ for a I by 1 vertical window such as 43 using an M by 1 averaging window. Using equation 7 microprocessor 18 can generate spatially averaged pixels $A_{ij}^n$ for a two-dimensional window such as 40 using an M by L averaging window.

Figure 5:
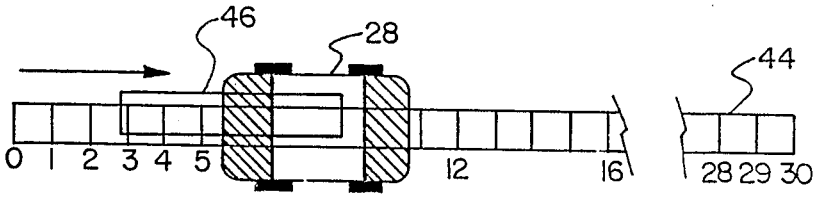
FIG. 5 is a graphic representation of the spatial averaging step performed by the spatial data processing method illustrated in FIG. 4.

FIG. 5 illustrates an example in which spatially averaged pixels $A_{ij}^n$ are generated for a one by thirty horizontal window 44 using a one by six (L=six) averaging window 46. Thus, Equation 5 becomes Equation 8 for L=6. In so doing, microprocessor 18 will average sequential groups of six background adjusted intensity values $\bar{I}_{ij}^n$ throughout the window 44. A first group of background adjusted pixels, $\bar{I}_i^n$ $_{(1 \leqq j \leqq 6)}$ is first averaged. Next, a second group of background adjusted pixels $\bar{I}_i^n$ $_{(2 \leqq j \leqq 7)}$ is averaged in a similar manner. This process is repeated by microprocessor 18 until background adjusted pixels $I_i$ $_{(25 \leqq j \leqq 30)}$ are averaged. The result is a spatially averaged array $A_{ij}^n$.

As indicated by step 56, microprocessor 18 next computes spatial variance $V_{ij}^n$ as a function of the background adjusted pixels $\bar{I}_{ij}^n$ and spatially averaged pixels $A_{ij}^n$. This is done for all values $\bar{I}_{ij}^n$ and $A_{ij}^n$ within the selected window such as 43 of the nth frame. Variance values $V_{ij}^n$ provide a measure of how much the background adjusted values $\bar{I}_{ij}^n$ vary from the spatially averaged values $A_{ij}^n$ within the variance window. The variance window, like the spatial average window, is sized so as to represent a vehicle such as 28. Microprocessor 18 can, for example, compute spatial variance values $V_{ij}^n$ over a one by L variance window using the formula of equation 9.

The variance ${}_AV_{ij}^n$ in the absence of a vehicle is estimated using Equation 9 with feedback from logic 58. If logic 58 decided that there is a vehicle in the window of interest the nth frame ${}_AV_{ij}^n$ is not updated, that is ${}_AV_{ij}^n = {}_AV_{ij}^{n-1}$. If logic decided that there is no vehicle present in the window then ${}_AV_{ij}^n$ is updated per Equation 9.

Logic 58 operates either on the background adjusted intensity $\bar{I}_{ij}^n$ or on the variance $V_{ij}^n$. If $\bar{I}_{ij}^n$ kf(${}_AV_{ij}^n$) or $V_{ij}^n > k_AV_{ij}^n$ where $1 \leqq k \leqq 4$ then, potentially, there is a vehicle present at the (ij) location and this is denoted by $$P_{ij}=1$$

Logic 58 accumulates Pij values over a window of length six. Using majority rule, if $$\sum_{j=1}^{6} P_{ij} \geqq 4$$

anywhere over the 1×K (K=30) window, a decision is made that a vehicle is present.

Passage is determined by vehicle detection at the first pixel of presence detection.

These procedures are illustrated with reference to FIG. 8 which shows a vehicle 28 present within a one by J horizontal window 70. Pixels $P_{i(6 \leqq j \leqq 11)}$ will have been set to "1" by microprocessor 18 per Equation 10, since vehicle 28 was present at the portion of the image covered by these pixels. Remaining pixels $P_{i\ 1 \leqq j \leqq 5}$ and $P_{i\ 12 \leqq j \leqq J}$ will be set to "0" since they do not represent portions of the image containing a vehicle. Detection window 72 is a one by six window in this example. The sum of the pixel values encompassed by detection window 72 (i.e. $P_{i\ 5 \leqq j \leqq 10}$) is compared to a constant X=4 as described by equation 11. In this case the sum will be equal to six so microprocessor 18 will generate a presence signal. If, for example, window 72 were encompassing pixels $P_{i\ 13 \leqq j \leqq 18}$, the sum would be equal to zero and microprocessor would generate a signal representative of vehicle absence.

Microprocessor 18 can also implement other statistical decision criteria such as Bayes for vehicle presence decision. Data representative of vehicle passage (e.g., of a signal switching logic state upon entry into the window of interest) can be determined in a similar manner. All of the above-described steps are successively repeated for each new frame.

Figure 6:
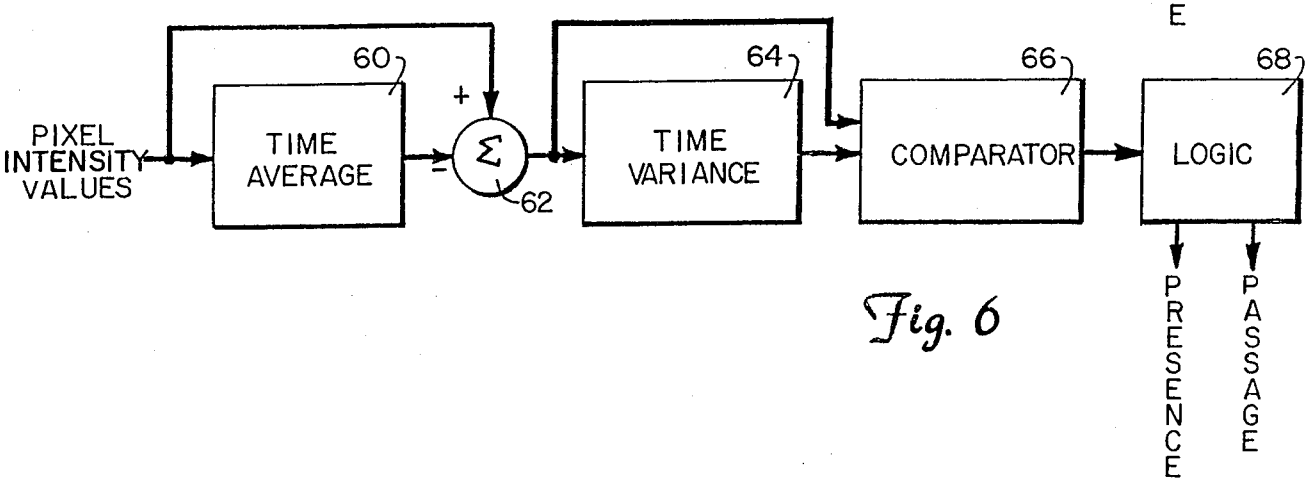
FIG. 6 is a block diagram representation of a temporal data processing method which can be performed by the system shown in FIG. 1.

A temporal data processing method which is implemented by microprocessor 18 to determine presence, passage and other vehicle characteristics such as velocity is illustrated generally in FIG. 6. The temporal approach estimates the background intensity of the road surface in the absence of vehicles. This is compared to the instantaneous (current frame) intensity and if the latter is greater statistically then a vehicle presence decision is made.

For temporal processing microprocessor 18 first time averages the intensity values to produce a time averaged array of pixels $\hat{I}_{ij}^n$ as indicated at step 60. Time averaged pixels $\hat{I}_{ij}^n$ are computed similarly to the spatial processing in accordance with Equations 1–3. Microprocessor 18 then generates a background adjusted array of pixels $\bar{I}_{ij}^n$ for the nth frame by subtracting the time average $\hat{I}_{ij}^n$ from the instantaneous pixels $I_{ij}^n$ per step 62 and Equation 4.

Utilizing the background adjusted intensity pixels, microprocessor 18 next generates time variance values $Q_{ij}^n$ for the nth frame over R preceding frames as indicated by step 64. Time variance values $Q_{ij}^n$ are generated as a function of background adjusted pixels $\bar{I}_{ij}^n$ of the previous R frames, and a mean or average intensity $M_{ij}$ at the corresponding pixel over N previous frames. Microprocessor 18 computes the time variance and mean values in accordance with Equations 12 and 13. In one embodiment, R and N are equal to twenty frames.

Microcomputer 18 also computes, as part of time variance step 64, background variance ${}_AQ_{ij}^n$ in the absence of vehicles, in a manner similar to that described with reference to spatial variance processing step 56 illustrated in FIG. 4. The background variance ${}_AQ_{ij}^n$ is computed as a function of a running average (Equations 12, 13). If the logic 68 decides that there is no vehicle present the variance is updated according to Equations 12, 13. If there is a vehicle present, according to logic 68, then ${}_AQ^n{}_{ij}={}_AQ^{n-1}{}_{ij}$. The comparator operates as follows. The background adjusted instantaneous intensity $\bar{I}_{ij}^n$ is compared to a function of the background variance per Equation 14. The function $f({}_AQ_{ij}^n)$ can, for example, be an absolute value or square root of background variance values ${}_AQ_{ij}^n$. Constant k will typically be between one and four. If the instantaneous background adjusted intensity is greater than the functional relationship of the background variance, a decision is made by the comparator that a vehicle is present in pixel ij. This is denoted by $P_{ij}=1$, otherwise $P_{ij}=0$ (no vehicle).

$P_{ij}$ pixels with values zero or one are inputs to logic 68 where they are processed to determine presence and passage of vehicles. The logical processing at step 68 is performed similarly to that described with reference to step 58 of the spatial processing method illustrated in FIG. 4, and described by equation 11. All of the above-described steps are successively repeated for each new frame or array of pixels $I_{ij}$.

Figure 9:
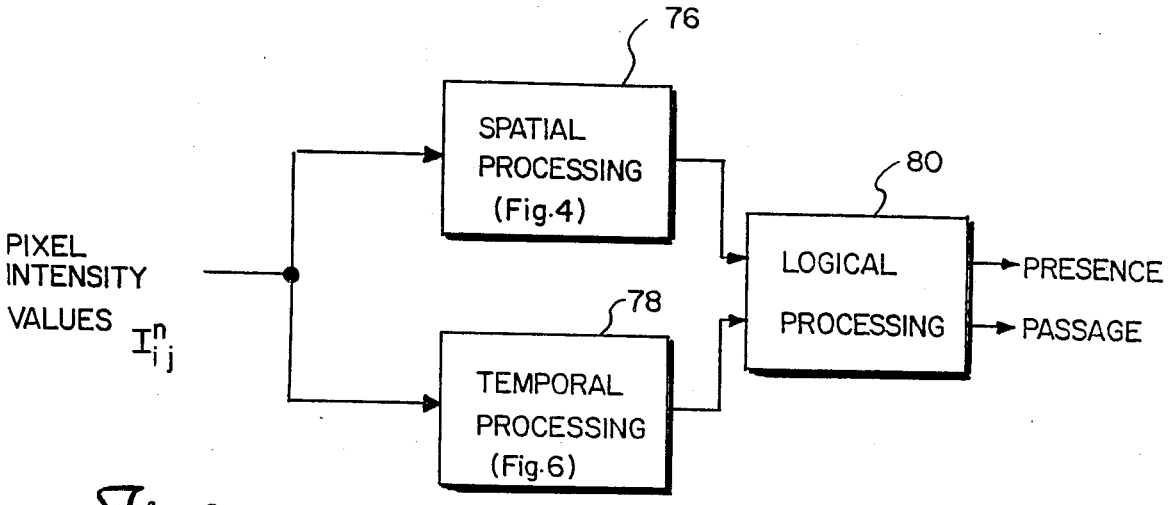
FIG. 9 is a block diagram representation of another processing method which can be implemented by the system shown in FIG. 1.

Although the spatial data processing method described with reference to FIG. 4 and the temporal data processing method described with reference to FIG. 6 provide accurate data relative to vehicle detection, the performance of system 10 can be improved through simultaneous use of these methods. As illustrated in FIG. 9, pixel intensity values $I_{ij}^n$ for selected windows of an nth frame can be simultaneously processed by microcomputer 18 in accordance with both the spatial and temporal processing methods (steps 76 and 78, respectively). The results from these two processing methods (e.g., data characteristic of presence, passage, or other characteristics) are then logically processed or combined as indicated at step 88 to produce signals or data characteristic of presence, passage or other characteristics. In one embodiment, microprocessor 18 implements a logical "AND" operation on the outputs of spatial and temporal processing steps 76 and 78, respectively, and generates presence or passage data only if presence or passage data was generated by both the spatial processing method and temporal processing method.

Figure 4:
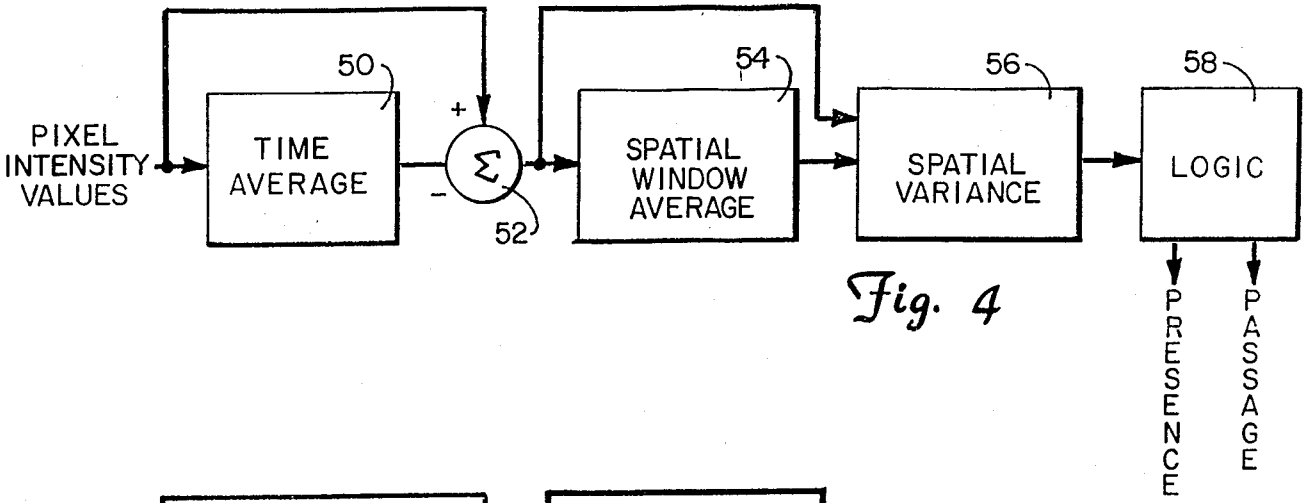
FIG. 4 is a block diagram representation of a spatial data processing method which can be performed by the system shown in FIG. 1.
Figure 10:
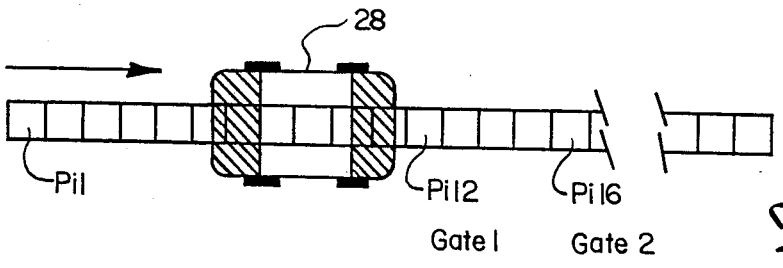
FIG. 10 is a graphic representation illustrating a velocity determination processing method.

Presence and/or passage data generated by microprocessor 18 through implementation of either the spatial processing technique shown in FIG. 4 or the temporal processing technique shown in FIG. 6 can be further processed by microprocessor 18 to produce vehicle velocity data. This processing method is described with reference to FIG. 10. The velocity data is computed by monitoring the logic state assigned to two gates such as $P_{i\,12}$ and $P_{i\,16}$ over several (N) frames. The spatial distance between pixels $P_{i\,12}$ and $P_{i\,16}$ corresponds to an actual distance D in the field of traffic based on the geometry and sensor parameter. Microprocessor 18 will monitor the number of elapsed frames N between the frame at which the logic state of pixel $P_{i\,12}$ switches from a logic "0" to a logic "1", and the frame at which the logic state represented by pixel $P_{i\,16}$ switches from logic "0" to a logic "1". The number of frames N separating these two events corresponds to the time $\Delta t$. Microprocessor 18 can thereby compute velocity using Equation 15. The accuracy of this determination can be improved through computations involving several pairs.

Although the present invention has been described with reference to preferred embodiments, workers skilled in the art will recognize that changes may be made in form and detail without departing from the spirit and scope of the invention.

What is claimed is:

1. A vehicle detection system including:

sensor means for sensing traffic in a field of view and for providing successive arrays of pixels characteristic of the field of view;

a formatter coupled to the sensor means and including an input terminal for receiving subarray selection information representative of changeable selected portions of the field of view and means for selecting subarrays of pixels characteristic of the selected portions of the field of view from the arrays provided by the sensor means; as a function of the subarray selection information and processor means for processing the selected subarrays of pixels and for providing data representing presence and/or passage of vehicles within the selected portions of the field view.

2. The system of claim 1 wherein the sensor means including:

a camera for providing video signals representative of the field of view; and digitizer means for digitizing the video signals to produce the arrays of pixels.

3. The system of claim 1 and further including a terminal coupled to the formatter and responsive to operator actuation.

4. The system of claim 1 wherein the processor means include means for spatially processing the subarrays of pixels.

5. The system of claim 1 wherein the processor means includes means for temporally processing the subarrays of pixels.

6. The system of claim 1 and further including monitor means coupled to the sensor means for providing a visual display of the selected portions of the field of view.

7. The system of claim 1 and further including traffic control/surveillance/counting-classifying means coupled to the processor means for controlling-/monitoring/classifying-counting traffic as a function of the data representing the presence and/or passage of vehicles.

8. The system of claim 1 and further including memory means for storing the data.

9. The system of claim 1 wherein the formatter includes means for receiving information representative of selected two-dimensional portions of the field of view.

10. A system of the type including imaging means for providing successive pixel arrays characteristic of a field of view including traffic, over time, and processor means for processing the pixels to produce data representative of presence and/or passage of vehicles within the field of view; which system includes a formatter coupled between the imaging means and the processor means, and including an input terminal for receiving subarray selection information data representative of changeable selected portions of the field of view and means for selecting subarrays of pixels characteristic of the selected portions of the field of view as a function of the subarray selection information for processing by the processor means.

11. The system of claim 10 and further including terminal means coupled to the formatter for permitting an operator to control the formatter and select pixels characteristic of desired selected portions of the field of view.

12. The system of claim 11 and further including monitor means coupled to the imaging means for providing a visual image of the field of view, wherein the operator uses the terminal means in conjunction with the monitor means to select pixels of interest within the field of view.

13. A method for operating programmable computing means to spatially process arrays of pixels representative of a field of view of traffic over time so as to generate data characteristic of presence of vehicles within the field of view, including:

receiving successive sensed arrays of pixels representative of a field of view of traffic over time;

time averaging corresponding pixels of successive sensed arrays over time to provide a time averaged array;

summing corresponding pixels of the time averaged array with pixels of a sensed array to generate a background adjusted array;

spatially averaging window groups of pixels of the background adjusted array to generate a spatially averaged array;

generating a spatial variance array of pixels as a function of corresponding pixels from the background adjusted array and pixels from the spatially averaged array; and generating data representative of vehicle presence as a function of pixels of the spatial variance array.

14. The method of claim 13 wherein spatially averaging window groups of pixels of the background adjusted array includes spatially averaging window groups of M by L pixels, where L is a predetermined number of horizontally adjacent pixels and M is a predetermined number of vertically adjacent pixels.

15. The method of claim 14 wherein spatially averaging window groups of pixels of the background adjusted array includes spatially averaging window groups of one by L pixels.

16. The method of claim 14 wherein spatially averaging window groups of pixels of the background adjusted array includes spatially averaging window groups of M by one pixels.

17. The method of claim 13 wherein generating a spatial variance array of pixels includes generating a spatial variance array of pixels as a function of variance window groups of corresponding pixels from the background adjusted array and the spatially averaged array.

18. The method of claim 13 wherein generating data as a function of pixels of the spatial variance array includes generating an absence variance array of pixels which is representative of the spatial variance of pixels in the absence of vehicles as a function of the data representative of vehicle presence and pixels of the spatial variance array, and generating data representative of vehicle presence as a function of pixels of the absence variance of array.

19. The method of claim 18 wherein generating data representative of vehicle presence as a function of pixels of the absence variance array includes:

generating an intermediate value as a function of pixels of the absence variance array;

comparing pixels of the spatial variance array to the intermediate value generated as a function of corresponding pixels of the absence variance array;

denoting pixels as representing a portion of the field of view at which a vehicle either potentially is or potentially is not present as a function of the comparison; and generating data representative of vehicle presence when at least a predetermined number of pixels within a window group of adjacent pixels are denoted as representing a portion of the field of view at which a vehicle potentially is present.

20. The method of claim 18 wherein generating data representative of vehicle presence and/or passage as a function of the absence variance of pixels includes:

generating an intermediate value as a function of the absence variance of pixels;

comparing pixels of the background adjusted array to the intermediate value generated as a function of corresponding pixels of the absence variance array;

denoting pixels as representing a portion of the field of view at which a vehicle either potentially is or potentially is not present as a function of the comparison; and generating data representative of vehicle presence when at least a predetermined number of pixels within a window group of adjacent pixels are denoted as representing a portion of the field of view at which a vehicle potentially is present.

21. The method of claim 13 and further including:

repeating the steps of time averaging corresponding pixels, summing corresponding pixels, spatially averaging window groups of pixels, generating a spatial variance array, and generating data representative of vehicle presence, so as to generate data representative of vehicle presence over time; and generating data representative of vehicle passage as a function of the data representative of vehicle presence over time.

22. A method for operating programmable computing means to temporally process arrays of pixels representative of a field of view of traffic over time so as to produce data characteristic of vehicle presence, including:

receiving successive sensed arrays of pixels representative of a field of view of traffic over time;

time averaging corresponding pixels of successive sensed arrays to produce a time averaged array;

summing corresponding pixels of the time averaged array and pixels of a sensed array to produce a background adjusted array;

generating a time variance array of time variance pixels as a function of corresponding pixels from a predetermined number of successive background adjusted arrays; and generating data representative of vehicle presence as a function of corresponding time variance pixels from the time variance array and background adjusted pixels from the background adjusted array.

23. The method of claim 22 wherein generating a time variance array of time variance pixels includes generating a time variance array of time variance pixels as a function of corresponding pixels from a predetermined number of successive background adjusted arrays, and an average of corresponding pixels from a predetermined number of successive background adjusted arrays.

24. The method of claim 22 wherein generating data representative of vehicle presence includes:

generating an absence variance array of absence variance pixels representative of the spatial variance pixels in the absence of vehicles, as a function of the data representative of vehicle presence and corresponding spatial variance pixels; and generating data representative of vehicle presence as a function of corresponding pixels from the absence variance array and pixels from the background adjusted array.

25. The method of claim 24 wherein generating data representative of vehicle presence as a function of corresponding pixels from the absence variance array and background adjusted array includes:

generating intermediate values as a function of pixels from the absence variance array;

comparing pixels from the background adjusted array to the intermediate values generated as a function of corresponding pixels from the absence variance array;

denoting pixels as representing a portion of the field of view at which a vehicle either potentially is or potentially is not present as a function of the comparison; and generating data representative of vehicle presence when at least a predetermined number of pixels within a window group of adjacent pixels are denoted as representing a portion of the field of view at which a vehicle potentially is present.

26. The method of claim 22 and further including:

repeating for a plurality of sensed arrays the steps of time averaging corresponding pixels, summing corresponding pixels, generating a time variance array, and generating data representative of vehicle presence, so as to provide data representative of vehicle presence over time; and generating data representative of vehicle passage as a function of the data representative of vehicle presence over time.

27. A method for operating programmable computing means to process successive sensed arrays of pixels representative of a field of view of traffic over time to generate data representative of presence of vehicles within the field of view, including:

independently spatially processing the arrays of pixels and generating spatially processed presence data representative of the presence of vehicles within the field of view;

temporally processing the arrays of pixels independent from the spatial processing step and generating temporally processed presence data representative of the presence of vehicles within the field of view; and generating output data representative of presence of vehicles within the field of view as a function of the spatially processed presence data and the temporally processed presence data.

28. The method of claim 27 wherein generating output data representative of presence of vehicles includes generating data representative of vehicle presence as a logical AND function of the spatially processed presence data and the temporally processed presence data.

29. The method of claim 27 and further including:

repeating for successive sensed arrays of pixels the step of spatially processing the arrays of pixels so as to generate data representative of the presence of vehicles within the field of view over time;

repeating for successive sensed arrays of pixels the step of temporally processing the arrays of pixels so as to generate temporally processed presence data representative of the presence of vehicles within the field of view over time; and generating data representative of passage of vehicles within the field of view as a function of the spatially processed presence data and the temporally processed presence data.

30. A vehicle detection system, including:

means for sensing traffic in a field of view and for providing successive arrays of pixels representative of the field of view;

means for controlling the selection of subarrays of pixels characteristic of changeable selected portions of the field of view from the arrays provided by the sensor means as a function of traffic within the field of view; and means for processing the selected subarrays of pixels and for providing data representative of presence and/or passage of vehicles within the selected portions of the field of view.

31. The system of claim 30 wherein the means for controllably selecting includes:

a monitor coupled to the means for sensing for providing a visual display of the field of view;

a terminal; and an operator observing the monitor and actuating the terminal to select desired portions of the field of view as a function of traffic within the field of view.

32. A method for determining information representative of the presence and/or passage of vehicles within a field of view, including:

sensing a field of view of traffic and generating arrays of pixels characteristic of the field of view;

controlling the selection of subarrays of pixels characteristic of changeable selected portions of the field of view from the generated arrays; and processing the selected subarrays of pixels and generating data representative of the presence and/or passage of vehicles within the selected portions of the field of view.

33. The method of claim 32 wherein controllably selecting subarrays includes selecting subarrays of pixels as a function of traffic within the field of view.

* * * * *

UNITED STATES PATENT AND TRADEMARK OFFICE

CERTIFICATE OF CORRECTION

PATENT NO. : 4,847,772

DATED : July 11, 1989

INVENTOR(S) : Panos G. Michalopoulos et al.

It is certified that error appears in the above-identified patent and that said Letters Patent is hereby corrected as shown below:

In the References Cited Section, under U.S. Patent Documents, add the following:

| | | | |
|---|---|---|---|
| 3,056,106 | 9/1962 | Hendricks | 340/31 |
| 3,436,540 | 4/1969 | Lamorlette | 250/83.3 |
| 3,972,021 | 7/1976 | Leitz, et al. | 340/38 |

In the References Cited Section, under Other Publications, add the following:

Reiss, Robert A., "Wide Area Detection in the 21st Century", Sperry Corporation

"Conceptual Design Summary for WADS", dated August 1985

"Optical Vehicle Detector Type 3P5JL-02", Omron Tateisi Electronics Co.

Omron Product Brochure identified by No. 2 S.58.10 and translation thereof;

S. Takaba, et al., "A Traffic Flow Measuring System Using a Solid-State Image Sensor", University of Tokyo, Japan, presented at the International Conference on Road Traffic Data Collection, London, England, December 1984

UNITED STATES PATENT AND TRADEMARK OFFICE

CERTIFICATE OF CORRECTION

PATENT NO. : 4,847,772

DATED : July 11, 1989

INVENTOR(S) : Panos G. Michalopoulos et al.

It is certified that error appears in the above-identified patent and that said Letters Patent is hereby corrected as shown below:

Dickinson, et al., "Image Processing Applied to Traffic, 1. A General Review", Traffic Engineering and Control, 25(1), January 1948, 6-13

Siemens Product Brochure entitled "IDP Infrared Detector for Road Traffic

Waterfall, et al., "Image Processing Applied to Traffic, Part 2 Practical Experience", Traffic Engineering and Control, February 1984

Inigo, Rafazlm, "Traffic Monitoring and Control Using Machine Vision: A Survey", IEEE Transactions on Industrial Electronics, Vol. 1 IE-32, No. 3, August 1985

Takaba et al., "Traffic Flow Measuring System With Image Sensors", Symp. on Road, Res. Progr. Tokyo, 1984

Signed and Sealed this

Eighth Day of May, 1990

*Attest:*

HARRY F. MANBECK, JR.

*Attesting Officer*

*Commissioner of Patents and Trademarks*